US007152927B1

(12) United States Patent
Halstrom

(10) Patent No.: US 7,152,927 B1
(45) Date of Patent: Dec. 26, 2006

(54) RATCHETED HEADREST FOR A RECLINER CHAIR

(76) Inventor: Lee O Halstrom, P.O. Box 545, Magalia, CA (US) 95954

( * ) Notice: Subject to any disclaimer, the term of this patent is extended or adjusted under 35 U.S.C. 154(b) by 0 days.

(21) Appl. No.: 11/006,416

(22) Filed: Dec. 7, 2004

(51) Int. Cl.
*A47C 7/36* (2006.01)

(52) U.S. Cl. ..... 297/408

(58) Field of Classification Search ..... 297/61, 297/391, 406, 407, 408, 409, 410
See application file for complete search history.

(56) References Cited

U.S. PATENT DOCUMENTS

| | | | | |
|---|---|---|---|---|
| 156,846 | A | 11/1874 | Fiske | |
| 511,195 | A | 12/1893 | Collins | |
| 968,403 | A | 8/1910 | Pfanschmidt | |
| 1,594,409 | A | 8/1926 | Emmert | |
| 2,282,109 | A | 5/1942 | Angell | |
| 2,781,082 | A | 2/1957 | Decker | |
| 2,828,810 | A * | 4/1958 | Barecki et al. | 297/396 |
| 3,024,064 | A * | 3/1962 | Spound | 297/61 |
| 3,603,642 | A | 9/1971 | Laessker | |
| 3,817,576 | A | 6/1974 | Ciavattoni et al. | |
| 3,871,704 | A * | 3/1975 | Shoemaker et al. | 297/61 |
| 4,014,594 | A | 3/1977 | Hain | |
| 4,641,884 | A | 2/1987 | Miyashita et al. | |
| 4,674,792 | A | 6/1987 | Tamura et al. | |
| 4,685,730 | A * | 8/1987 | Linguanotto | 297/316 |
| 5,026,120 | A | 6/1991 | Takeda et al. | |
| 5,346,283 | A * | 9/1994 | Steininger et al. | 297/408 |
| 5,992,937 | A | 11/1999 | Pilhall | |

FOREIGN PATENT DOCUMENTS

| | | |
|---|---|---|
| GB | 2.112.637 | 7/1983 |

* cited by examiner

*Primary Examiner*—Milton Nelson, Jr.
(74) *Attorney, Agent, or Firm*—Michael I. Kroll

(57) ABSTRACT

A recliner that is independently adjustable relative to the recliner. The headrest in the non-operative position is in planar alignment with the back of the recliner and can be incrementally moved toward the anterior end of the recliner, so that when a user moves the recliner toward a horizontal position the headrest can be used to support the head in a forward position, such as would be desirable watching television. The headrest includes a pivotal headrest having at least one pawl engaging a toothed member so that the headrest can be incrementally moved according to the spacing of the toothed member. When it is desirous to return the headrest to its starting position the headrest is moved forward until the pawl disengages and is locked in a non-engaging position so that the headrest can be returned to its starting position whereupon the pawl will engage a tab moving the pawl into engagement with the toothed member.

9 Claims, 10 Drawing Sheets

RATCHETED HEADREST FOR A RECLINER CHAIR

BACKGROUND OF THE INVENTION

1. Field of the Invention

The present invention relates generally to headrests and, more specifically, to a ratcheted headrest for a recliner that is independently adjustable relative to the recliner. The headrest in the non-operative position is in planar alignment with the back of the recliner and can be incrementally moved toward the anterior end of the recliner, thereby when a user moves the recliner toward a horizontal position the headrest can be used to support the head in a forward position, such as would be desirable watching television.

The headrest of the present invention is comprised of a pivotal headrest having at least one pawl engaging a toothed member whereby the headrest can be incrementally moved according to the spacing of the toothed member. When it is desirous to return the headrest to its stating position the headrest is moved forward until the pawl disengages and is locked in a non-engaging position whereby the headrest can be returned to its starting position whereupon the pawl will engage a tab moving the pawl into engagement with the toothed member.

2. Description of the Prior Art

There are other headrest device designed for chairs. Typical of these is U.S. Pat. No. 156,846 issued to Fiske on Nov. 17, 1874.

Another patent was issued to Collins on Dec. 19, 1893 as U.S. Pat. No. 511,195. Yet another U.S. Pat. No. 968,403 was issued to Pfanschmidt on Aug. 23, 1910 and still yet another was issued on Aug. 3, 1926 to Emmert as U.S. Pat. No. 1,594,409.

Another patent was issued to Angell on May 5, 1942 as U.S. Pat. No. 2,282,109. Yet another U.S. Pat. No. 2,781,082 was issued to Decker on Feb. 12, 1957. Another was issued to Laessker on Sep. 7, 1971 as U.S. Pat. No. 3,603,642 and still yet another was issued on Jun. 18, 1974 to Ciavattoni, et al. as U.S. Pat. No. 3,817,576.

Another patent was issued to Hain on Mar. 29, 1977 as U.S. Pat. No. 4,014,594. Yet another U.S. Pat. No. 4,641,884 was issued to Miyashita, et al. on Feb. 10, 1987. Still another was issued to Tamura, et al. on Jun. 23, 1987 as U.S. Pat. No. 4,674,792. Another was issued on Jun. 25, 1991 to Takeda, et al. as U.S. Pat. No. 5,026,120.

Another was issued to Pilhall on Nov. 30, 1999 as U.S. Pat. No. 5,992,937. Another was issued on Jul. 27, 1983 to Kowalski as U.K. Patent No. GB2112637.

U.S. Pat. No. 156,846

Inventor: Austin S. Fiske

Issued: Nov. 17, 1874

The invention is designed to be used in a portable head-rest, though several of them are equally applicable to a stationary head-rest. The objects of my invention are to construct a head-rest compact in form, and which can be easily adjusted in various positions, as hereinafter more fully set forth; and these objects I accomplish by the several devices herein described and claimed. The combination of the rod A, hinged rest D, cross-bar B, rods C C', and bar L, substantially as and for the purpose specified.

U.S. Pat. No. 511,195

Inventor: Timothy J. Collins

Issued: Dec. 19, 1893

In a chair, a base, a cylindrical exteriorly screw threaded shell secured thereon, having transverse grooves along its length, a seat support threaded upon the shell having a dog for engagement with the grooves, bars pivotally secured upon the support, having ratcheted segments, the ratchet teeth of the segments being inclined in opposite directions, pawls pivotally secured to the seat support and adapted to engage the ratcheted segments to adjust the inclination of the seat, and a single lever to operate the said dog and pawls.

U.S. Pat. No. 968,403

Inventor: Charles Pfanschmidt

Issued: Aug. 23, 1910

In combination with a head rest for barbers' chairs, an adjusting bar; angular adjusting means for the head rest, comprising outer and intermediate ears on the adjusting bar, companion ears carried by the head rest, entered between the outer and intermediate ears of the adjusting bar, means for connecting the ears, said means serving as a pivotal mounting to permit the head rest to be swung around the adjusting bar during the angular adjustment thereof, the intermediate ear of the adjusting bar having a single hole therein, and one of the ears on the headrest having a plurality of holes therein adapted to register with the hole in the ear of the adjusting bar as the head rest is swung around, a lug-having a cam-surface secured to the head rest, a locking pin passing through said lug and capable of rotation therein, a collar having a cam surface secured to the locking pin, the pin, when projected, passing through a selected hole in the ear of the head rest and a. hole in the ear of the adjusting bar, and serving to lock the head rest against rotative movement and maintain it in desired, position of angular adjustment, the rotation of the pin causing the two cam surfaces to co-act and withdraw the pin from the selected hole in the ear of the head rest and permit the angular adjustment of the head rest, the movement of the locking pin being, insufficient to withdraw it from the ear of the adjusting bar, whereby said ear serves as a mounting and guide for the acting end of the pin, and a spring adapted to project the pin into locking position when a counter-rotative movement is imparted thereto, substantially as described.

U.S. Pat. No. 1,594,409

Inventor: John R. Emmert

Issued: Aug. 3, 1926

A head rest, provided with end plates one of which has an opening therethrough, in combination with a fixed clamping jaw secured to and rigidly connecting said end plates, a movable jaw provided at intervals of its length with non-perforating teeth opposed to the face of said fixed jaw, a spring for normally maintaining the movable jaw in its clamping position, and an operating handle secured to the movable jaw, which handle terminates in substantially the plane of the outer surface of said plate and is accessible through the opening therein.

U.S. Pat. No. 2,282,109

Inventor: Robert C. Angell

Issued: May 5, 1942

A folding chair comprising a seat and backrest, a supporting structure cooperatively supporting said seat and back and having a supporting prop, and including legs pivoted thereto on widely spaced relatively angular axes normally maintaining them in spreading relation, and causing them when turned into folded position to assume a relatively parallel relation with said prop, and a backrest supporting slide-bar hingedly connected with said prop.

U.S. Pat. No. 2,781,082

Inventor: Eugene M. Decker

Issued: Feb. 12, 1957

An upholstered lounging chair comprising a body structure including connected seat, arms and back all of which are covered by upholstery, said back having adjacent its upper end a rearwardly inclined frame member, ahead rest having at its lower side a transverse frame member, hinges connecting said members, a plate carried by said back frame member, said plate having a portion at one side thereof turned upwardly and shaped to form a rack bar overlying a groove in the back frame member, said plate being cut away at the upper end of the rack bar to expose the groove beneath the rack bar, a flat spring disposed in said groove and extending beyond the lower end of said plate, an arm pivoted to the head rest member having a lower lateral portion engaging said rack and a spring connected to said arm for swinging said lower arm lateral portion downwardly to provide positive engagement with the rack bar as the head rest is moved toward the front of the chair, said lower arm portion moving off the rack bar at the upper end thereof and through the slot into said groove and into engagement with the flat spring upon return movement to the lower end of the rack bar.

U.S. Pat. No. 3,603,642

Inventor: Fritz B. Laessker

Issued: Sep. 7, 1971

An articulated headrest for dental chairs and the like comprising:

a. a support member adapted for attachment to a dental chair;

b. a headrest frame journaled to said support member;

c. a pair of axially aligned toothed clutch members within said headrest frame, a first of said clutch members fixed to said support member and coaxial with said journal, and a second clutch member fixed to said headrest frame and being axially movable for engagement and disengagement with said first clutch member;

d. a pin fixed to said headrest frame, said pin having the axis thereof generally parallel with the axis of said second clutch member;

e. a lever arm having a first end fixed to said second clutch member and a second end slidably engaging said pin, said lever arm and pin comprising means for fixing said second clutch member to said frame;

f. bias means within said headrest frame normally urging said clutch members into engagement for locking said headrest frame against movement about said journal; and g. drive means within said headrest frame connected to said second clutch member for axially moving said second clutch member against said bias means to disengage said clutch members and permit articulation of said headrest frame with respect to said support member.

U.S. Pat. No. 3,817,576

Inventor: Anthony Ciavattoni

Issued: Jun. 18, 1974

The combination of a dental chair with a headrest, said headrest comprising supporting means which is mounted to the upper end of the backrest of said chair, rest means against which a patient may rest his head while sitting in said chair, said rest means extending upwardly from the top of said backrest and being pivotally connected at its lower end to a first location on said supporting means so as to permit said headrest to be pivoted forward and backward with respect to said backrest, lever means pivotally connected at one end thereof to a second location on said supporting means, means connected to the back of said rest means for slidably confining the movement of the other end of said lever means to a predetermined path of predetermined length when the headrest is pivoted about said first location on said supporting means, and means for locking the other end of said lever means in any one of various positions along said path so as to lock said headrest in a desired position with respect to said chair.

U.S. Pat. No. 4,014,594

Inventor: Larry A. Hain

Issued: Mar. 29, 1977

An angularly adjustable headrest for an operatory chair having means to quickly and effectively latch and unlatch the headrest pad relative to the supporting member incident to positioning the headrest member at a desired angle relative to the back of the chair.

U.S. Pat. No. 4,641,884

Inventor: Norio Miyashita

Issued: Feb. 10, 1987

A seat for a vehicle in which a seat back is separated into a plurality of portions in the vertical direction and a reclinable angle of each of the plurality of separated portions can be varied is disclosed, which includes a reclining device provided in connection with the lowest portion of the separated portions and a cushion of the seat for adjusting a reclinable angle of the lowest portion relative to the cushion of the seat, a plurality of angle adjusting devices each provided in connection with adjacent ones of the separated portions for adjusting an angle of an upper portion of the adjacent ones relative to a lower portion thereof, a fine adjusting member provided in connection with each of the plurality of angle adjusting devices for finely adjusting the angle of the upper portion, a member for coupling each of the plurality of angle adjusting devices to the reclining device to thereby operate the plurality of angle adjusting devices in response to each operation of the reclining device, whereby the separated portions can be varied to various reclinable postures and the reclined postures of the separated portions can be adjusted finely.

U.S. Pat. No. 4,674,792

Inventor: Hisao Tamura

Issued: Jun. 23, 1984

A position adjustable see-through headrest comprises a lower frame shaft which extends across parallel headrest stays extending from a seatback, a pivotal reversed U-shaped structure pivotally connected to the lower frame shaft so as to be pivotal about the axis of the lower frame shaft, a position adjusting mechanism arranged between the pivotal reversed U-shaped structure and the lower frame shaft in a manner to lock the pivotal reversed U-shaped structure to a selected one of the angular positions relative to the fixed lower frame shaft, a cover member covering the mechanism so as to conceal the same from the exterior of the cover member without affecting the function of the mechanism, and a pad member covering substantially entire of a unit which includes the lower frame shaft, the pivotal reversed U-shaped structure and the position adjusting mechanism.

U.S. Pat. No. 5,026,120

Inventor: Nobuhiko Takeda, et al.

Issued: Jun. 25, 1991

A headrest assembly for vehicle seats includes a first stationary link and a second link connected to the first link and side walls of a bracket for padded member. A rod is rotatably connected to the first link and received in slots on the bracket. When a motor mounted on the bracket is actuated, a screw member engaged with a nut member which is fixed on the rod causes the bracket to be swiveled.

U.S. Pat. No. 5,992,937

Inventor: Stig Pihall

Issued: Nov. 30, 1999

Adjustable head rests are disclosed for vehicle seats including a first support mounted on the vehicle seat, a second support pivotally mounted with respect to the first support, the second support mounting a head rest, and an adjustable control for adjusting the position of the second support into a plurality of locked annular positions with respect to the first support, the adjustable control extending substantially within the boundary surface of the head rest and adapted to be engaged by the fingers of an occupant in the vehicle seat.

U.K. Patent Number GB 2 112 637

Inventor: Jerome R. Kowalski

Issued: Jul. 27, 1983

A headrest arrangement to be mounted on a bracket of a chair, especially a wall-proximity reclining chair, includes a support consisting of two support members which are articulately connected to one another, and a kinematic linkage which mounts the support on the backrest movement between a retracted and an extended position. The headrest arrangement further includes a cushion member on the upper one of the support members, and a connecting link which connects the upper support member to undergo angular movement relative to the lower support member when the headrest is extended in the retracted position, the headrest arrangement is housed in a recess in the backrest the connecting link has a variable length and is urged by a spring to its position of shortest length the spring force can be overcome by the head of the user resting on the cushion member, to give additional comfort.

While these headrests may be suitable for the purposes for which they were designed, they would not be as suitable for the purposes of the present invention, as hereinafter described.

SUMMARY OF THE PRESENT INVENTION

The present invention discloses a ratcheted headrest for a recliner that is independently adjustable relative to the recliner. The headrest in the non-operative position is in planar alignment with the back of the recliner and can be incrementally moved toward the anterior end of the recliner, thereby when a user moves the recliner toward a horizontal position the headrest can be used to support the head in a forward position, such as would be desirable watching television. The headrest of the present invention is comprised of a pivotal headrest having at least one pawl engaging a toothed member whereby the headrest can be incrementally moved according to the spacing of the toothed member. When it is desirous to return the headrest to its starting position the headrest is moved forward until the pawl disengages and is locked in a non-engaging position whereby the headrest can be returned to its starting position whereupon the pawl will engage a tab moving the pawl into engagement with the toothed member.

A primary object of the present invention is to provide a headrest for a recliner that can be moved independently relative to the rest of the recliner.

Another object of the present invention is to provide a headrest that can be moved in increments from a starting position to an ending position.

Yet another object of the present invention is to provide a headrest having means for disengaging the pawl whereby the headrest can be moved to a starting position.

Still yet another object of the present invention is to provide a headrest forming an integral part of a recliner.

Another object of the present invention is to provide a headrest having at least one pawl engaging a toothed member whereby said headrest can be selectively positioned to a plurality of angular displacements.

Yet another object of the present invention is to provide a headrest having an exterior positioned handle for selectively pivoting the headrest to a desired position.

Still yet another object of the present invention is to provide a recliner having a headrest that be independently pivoted to a selective position regardless of the position of the recliner mechanism Additional objects of the present invention will appear as the description proceeds.

The present invention overcomes the shortcomings of the prior art by providing a ratcheted headrest for a recliner that is independently adjustable relative to the recliner. The headrest in the non-operative position is in planar alignment with the back of the recliner and can be incrementally moved toward the anterior end of the recliner, thereby when a user moves the recliner toward a horizontal position the headrest can be used to support the head in a forward position, such as would be desirable watching television.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
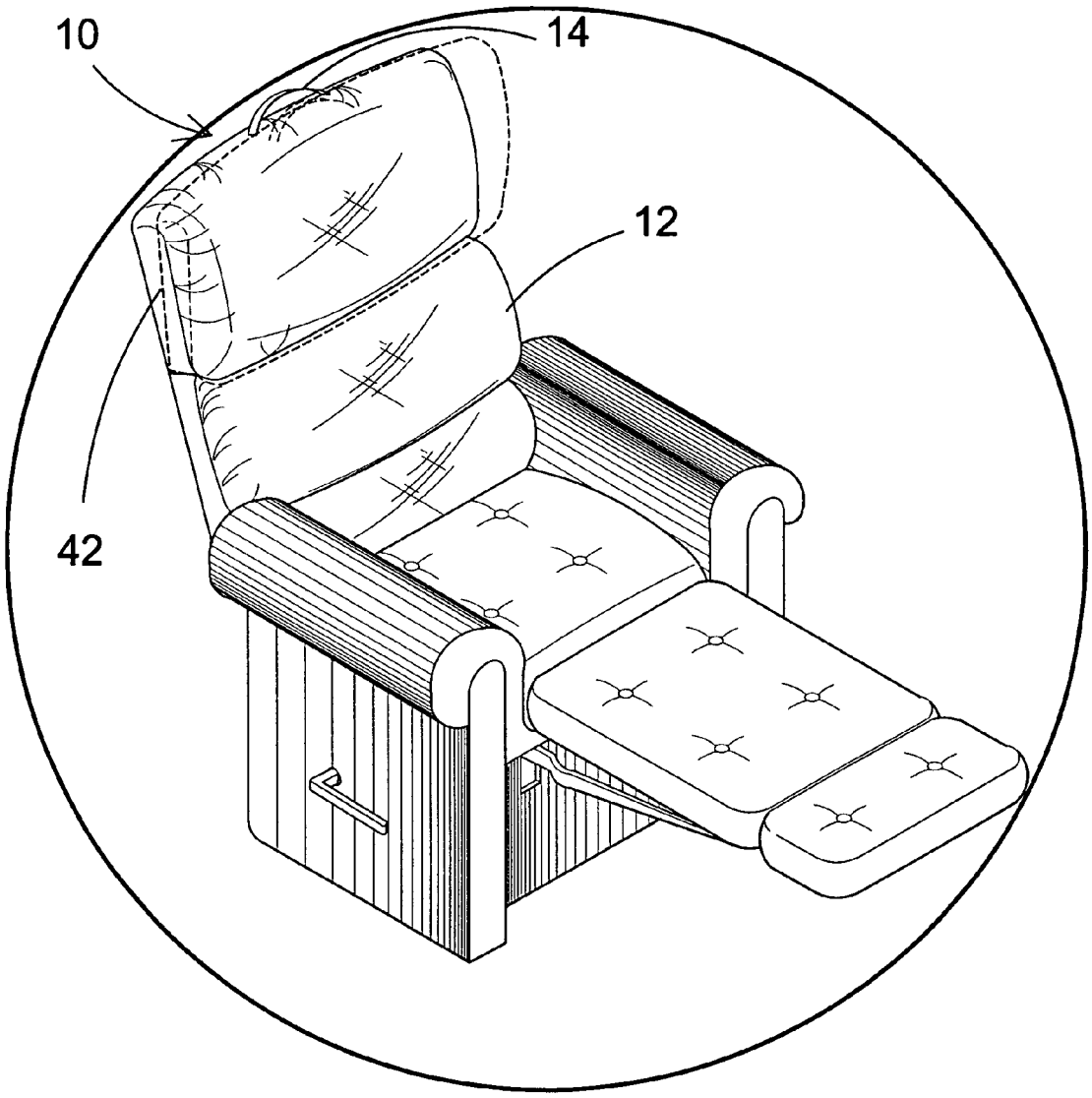
FIG. 1 is an illustrative view of the present invention in use.

With regard to reference numerals used, the following numbering is used throughout the drawings.

10 present invention
12 recliner
14 loop
16 frame
18 stationary plate
20 rotative plate
22 hinge
24 ratchet assembly
26 spring
27 spring
28 right inside surface of frame
30 pawl
32 cylinder/shaft
34 beveling
36 ratchet teeth
38 upper stop
39 lower stop
40 toothed member
42 headrest
44 seat back
46 upper portion
48 lower portion
50 upper portion
52 lower portion
54 offset
56 space
58 upper portion
60 lower portion
62 cover

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses an angularly adjustable recliner 12 headrest 42 having a ratchet mechanism for incremental adjustment of the headrest. The device 10 having a loop 14 handle thereon is designed to support the head completely and comfortably while the user is in a reclined position. The headrest 42 is adjusted to allow the user a comfortable head angle while watching television, reading or any visual activities.

Figure 2:
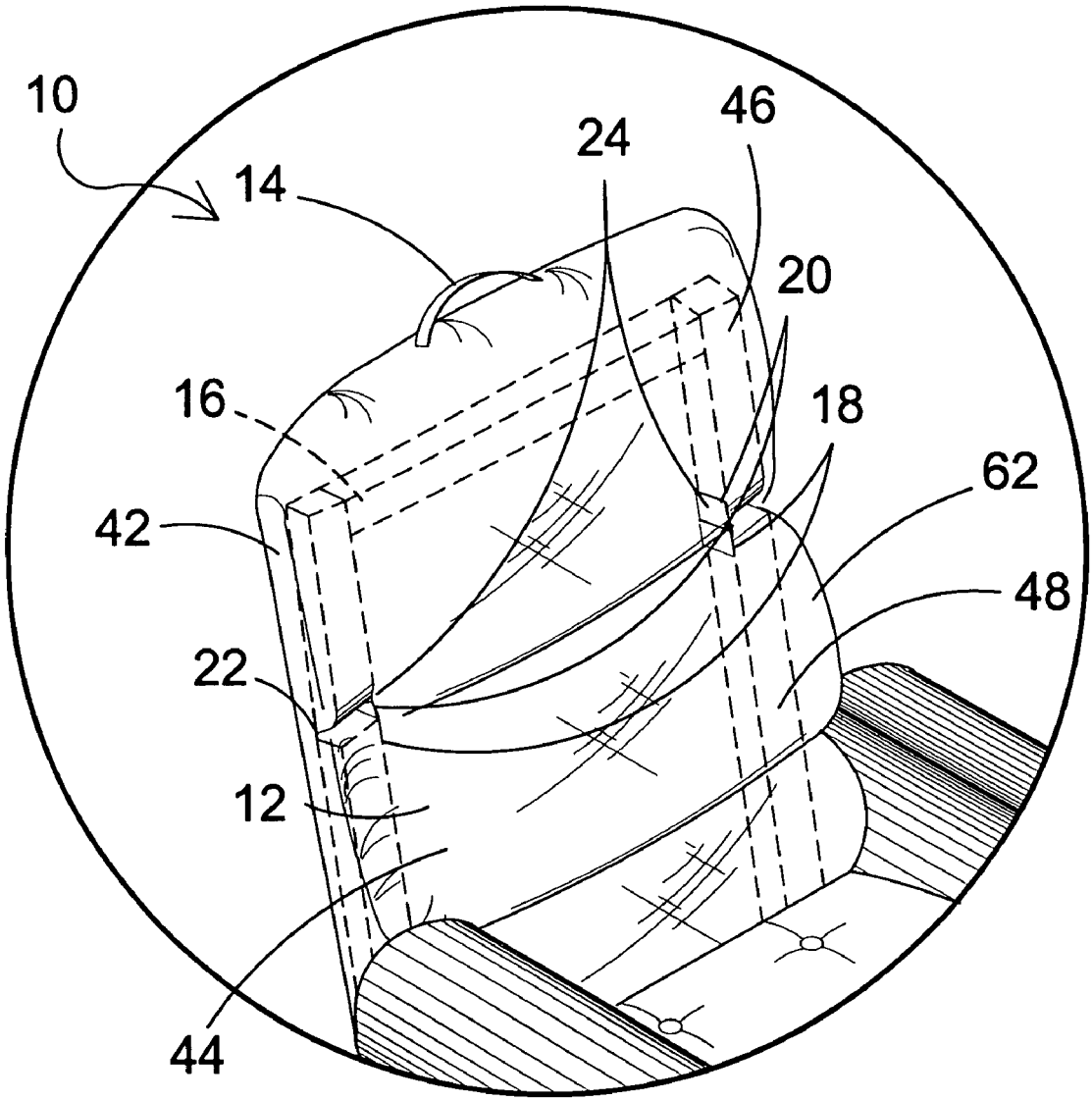
FIG. 2 is a detailed view of the present invention.

Turning to FIG. 2, shown therein is a detailed view of the present invention 10. The present invention 10 discloses an angularly adjustable recliner 12 with seat back 44 and headrest 42 having two rigid plates fixedly attached to the side walls of the recliner frame 16 and comprised of a ratchet system 24 housed within a stationary end plate 18, having a rotative inner plate 20 with a hinge 22 mounted to the back of the frame which functions as a pivoting element. Frame 16 has an upper 46 and lower 48 portion with the upper portion having a lower end and the lower portion having an upper end which are pivotally connected to allow the headrest 42 to move from a planar position to a forward position. The inner plate comprises a small ratchet plate having a series of teeth arranged whereby a pawl having a tip contacts the teeth to lock the headrest in a position desirable to the user. Also shown is loop 14 and cover 62 for covering the chair.

Figure 3:
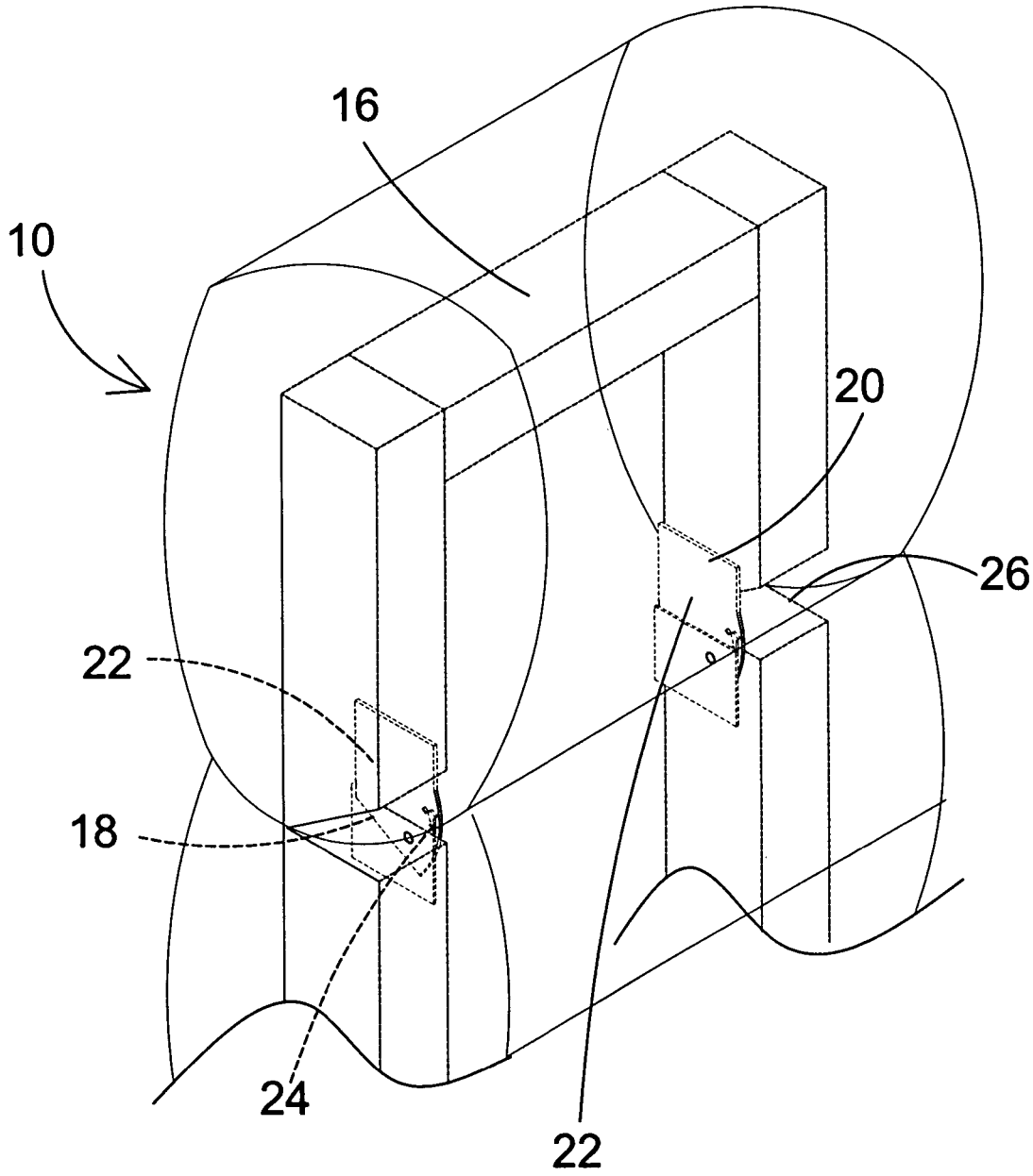
FIG. 3 is a detailed view of the present invention.

Turning to FIG. 3, shown therein is a detailed view of the present invention 10. The present invention 10 discloses an angularly adjustable recliner headrest having two rigid plates fixedly attached to the side walls of the recliner frame 16 and comprised of a ratchet system 24 housed within a stationary end plate 18, having a rotative inner plate 20 with a left and right hinge 22 mounted to the back of the frame which functions as a pivoting element. The inner plate comprises a small ratchet plate having a series of teeth arranged whereby a pawl having a tip contacts the teeth to lock the headrest in a position desirable to the user. Also shown is tension spring 26.

Figure 4:
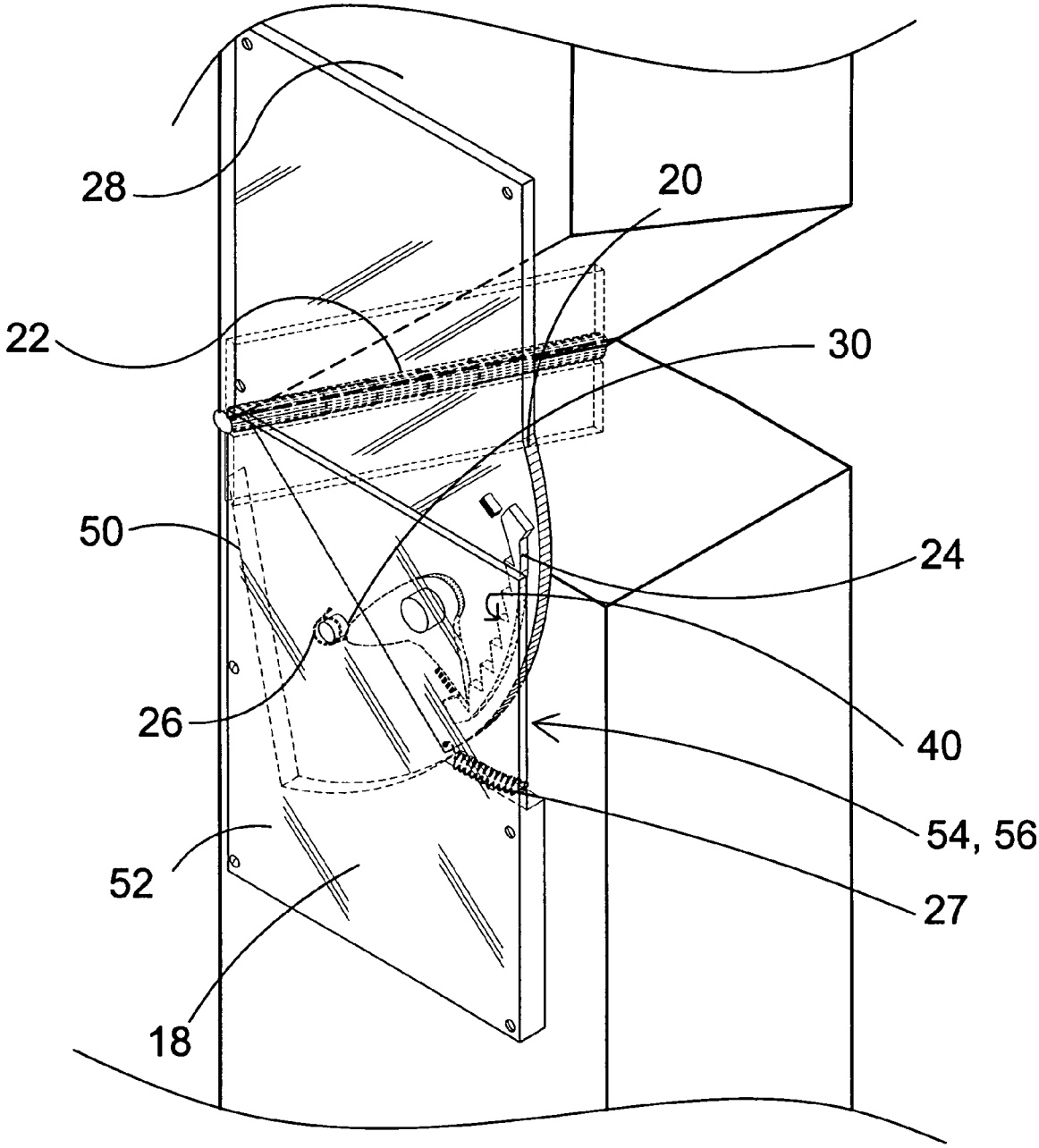
FIG. 4 is a detailed view of the ratchet assembly of the present invention.

Turning to FIG. 4, shown therein is a detailed view of the ratchet assembly of the right inside surface of frame 28 of the present invention 10. The present invention 10 discloses an angularly adjustable recliner headrest having two rigid plates fixedly attached to the side walls 28 of the recliner frame and comprised of a ratchet system 24 housed within a stationary end plate 18, having a rotative inner plate 20 with a hinge 22 of the right frame mounted to the back of the frame which functions as a pivoting element. Stationary plate 18 has an upper 50 and lower 52 portion with an offset 54 away from the frame member to form a space 56 therein. The inner plate 20 comprises a small ratchet plate 40 having a series of teeth arranged whereby a pawl 30 having a tip contacts the teeth to lock the headrest in a position desirable to the user. Also shown are springs 26, 27 and toothed member 40.

Figure 5:
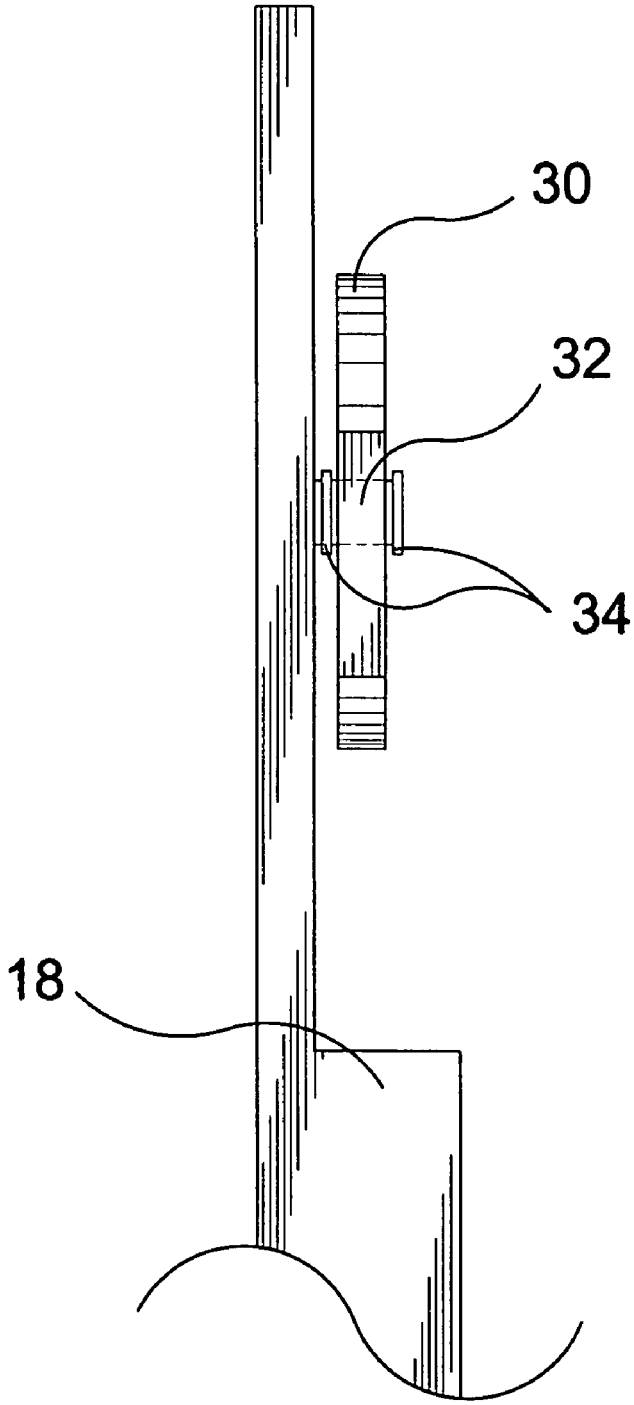
FIG. 5 is a front view of the stationary plate and pawl of the present invention in the top position.

Turning to FIG. 5, shown therein is a front view of the stationary plate 18 and pawl 30 of the present invention in the top position. The present invention 10 discloses an angularly adjustable recliner headrest having two rigid plates fixedly attached to the side walls of the recliner frame and comprised of a ratchet system housed within a stationary end plate, having a rotative inner plate with a hinge mounted to the back of the frame which functions as a pivoting element. The inner plate comprises a small ratchet plate having a series of teeth arranged whereby a pawl having a tip contacts the teeth to lock the headrest in a position desirable to the user. Also shown are cylinder 32 and beveling 34.

Figure 6:
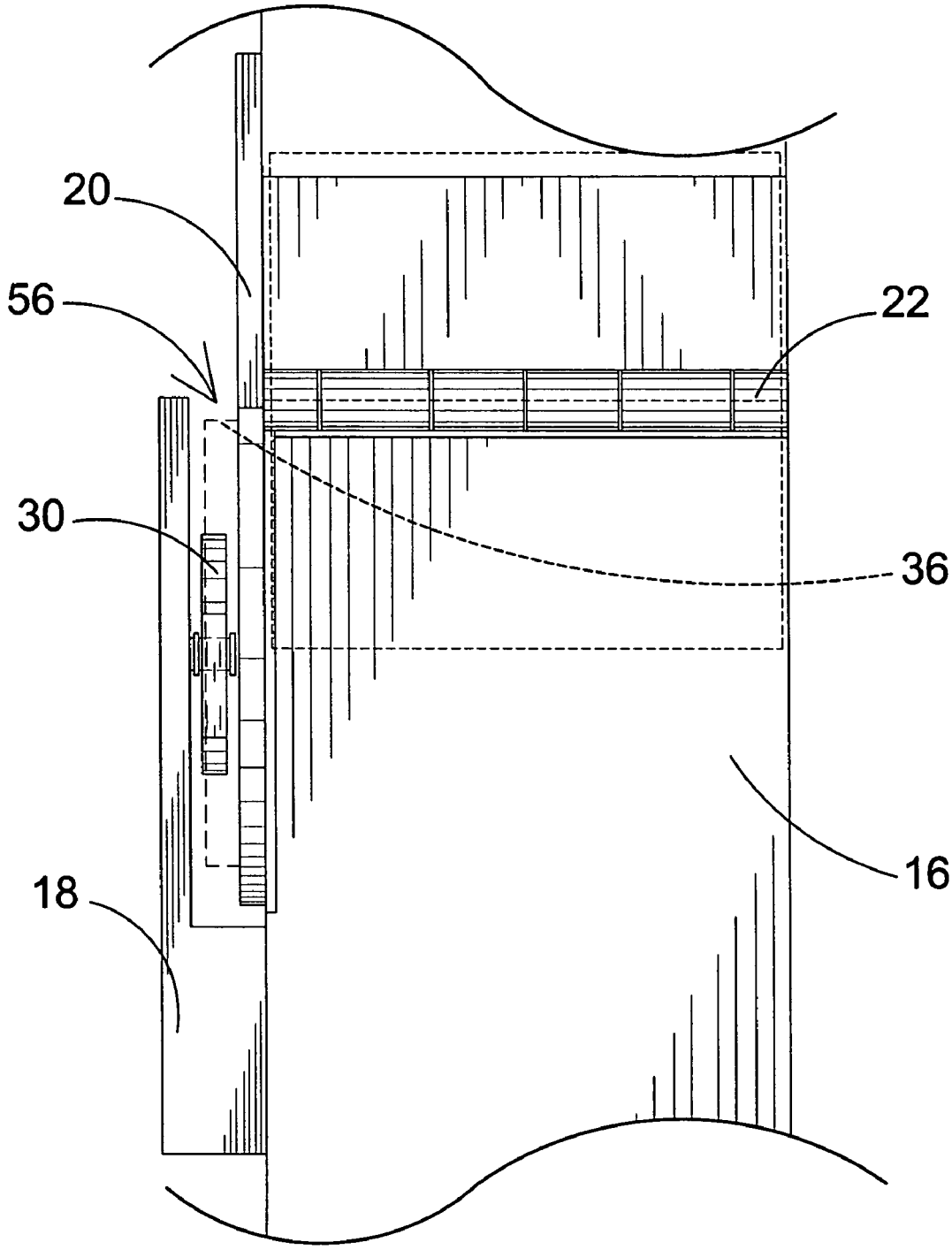
FIG. 6 is a detailed front view of the present invention.

Turning to FIG. 6, shown therein is a detailed front view of the present invention. The present invention 10 discloses an angularly adjustable recliner headrest having two rigid plates fixedly attached to the side walls of the recliner frame 16 and comprised of a ratchet system housed within a stationary end plate 18, having a rotative inner plate 20 with a hinge 22 mounted to the back of the frame which functions as a pivoting element. The inner plate 20 comprises a small ratchet plate having a series of teeth 36 arranged whereby a pawl 30 having a tip contacts the teeth to lock the headrest in a position desirable to the user. Also shown are pawl 30, space 56 and ratchet teeth 36.

Figure 7:
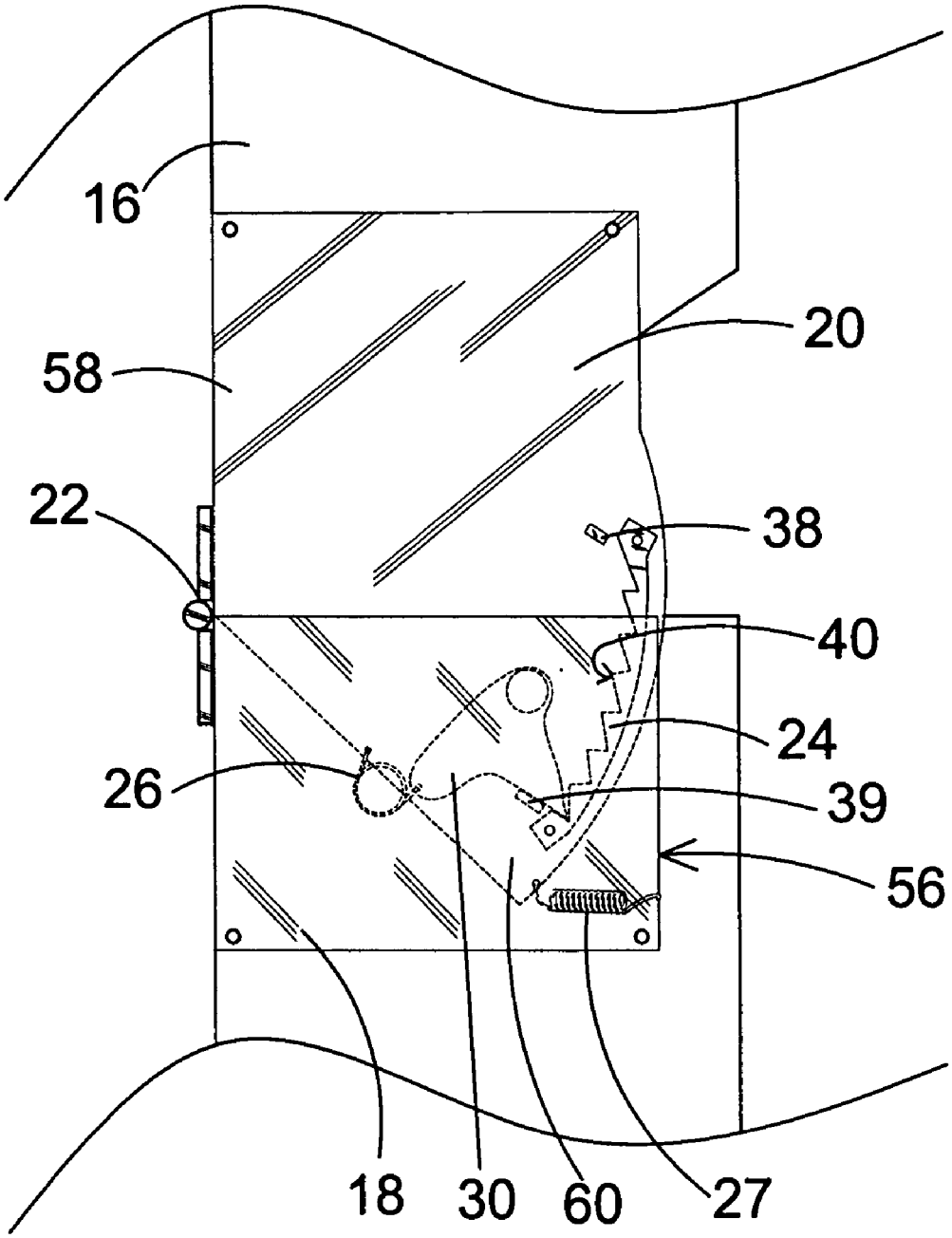
FIG. 7 is a side view of the ratchet assembly of the present invention in the top position.

Turning to FIG. 7, shown therein is a side view of the ratchet assembly of the present invention in the top position. The present invention 10 discloses an angularly adjustable recliner headrest having two rigid plates fixedly attached to the side walls of the recliner frame and comprised of a ratchet system 24 housed within a stationary end plate 18, having a rotative inner plate 20 with a hinge 22 mounted to the back of the frame 16 which functions as a pivoting element. The rotatable plate has an upper 58 and lower portion 60 extending into and moving in space 56. The inner plate 20 comprises a small ratchet plate 40 having a series of teeth arranged whereby a pawl 30 having a tip contacts the teeth 36 to lock the headrest in a position desirable to the user. Also shown are helical spring 26 biasing the pawl 30 clockwise and longitudinally compressible spring 27 biasing inner plate 20 counterclockwise, upper 38 and lower 39 stop and toothed member 40.

Figure 8:
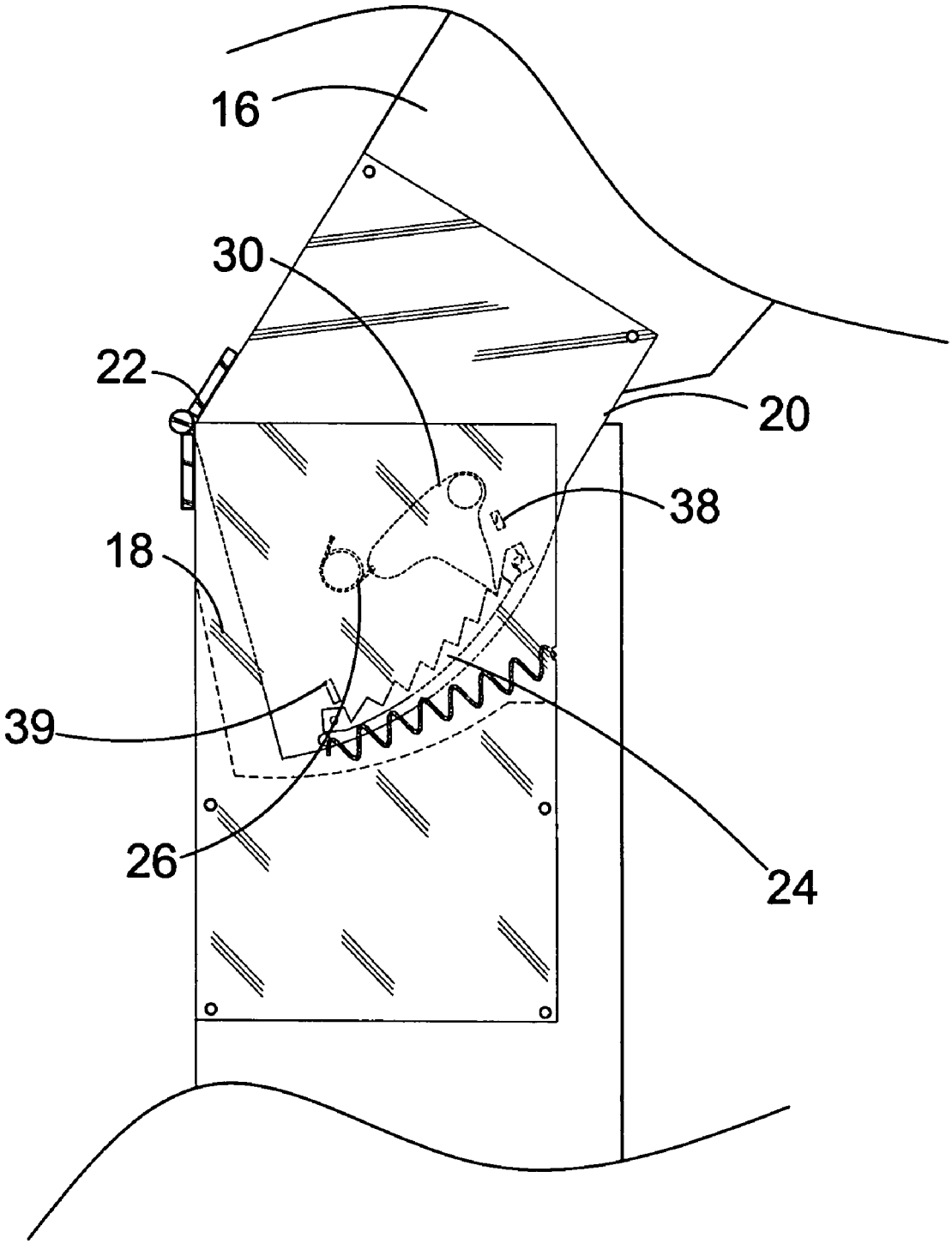
FIG. 8 is a side view of the ratchet assembly of the present invention in the last position.

Turning to FIG. 8, shown therein is a side view of the ratchet assembly of the present invention in the last position. The present invention 10 discloses an angularly adjustable recliner headrest having two rigid plates fixedly attached to the side walls of the recliner frame and comprised of a ratchet system 24 housed within a stationary end plate 18, having a rotative inner plate 20 with a hinge 22 mounted to the back of the frame 16 which functions as a pivoting element. The inner plate 20 comprises a small ratchet plate 24 having a series of teeth arranged whereby a pawl having a tip contacts the teeth to lock the headrest in a position desirable to the user. Also shown are pawl 30, spring 26 and stops 38, 39.

Figure 9:
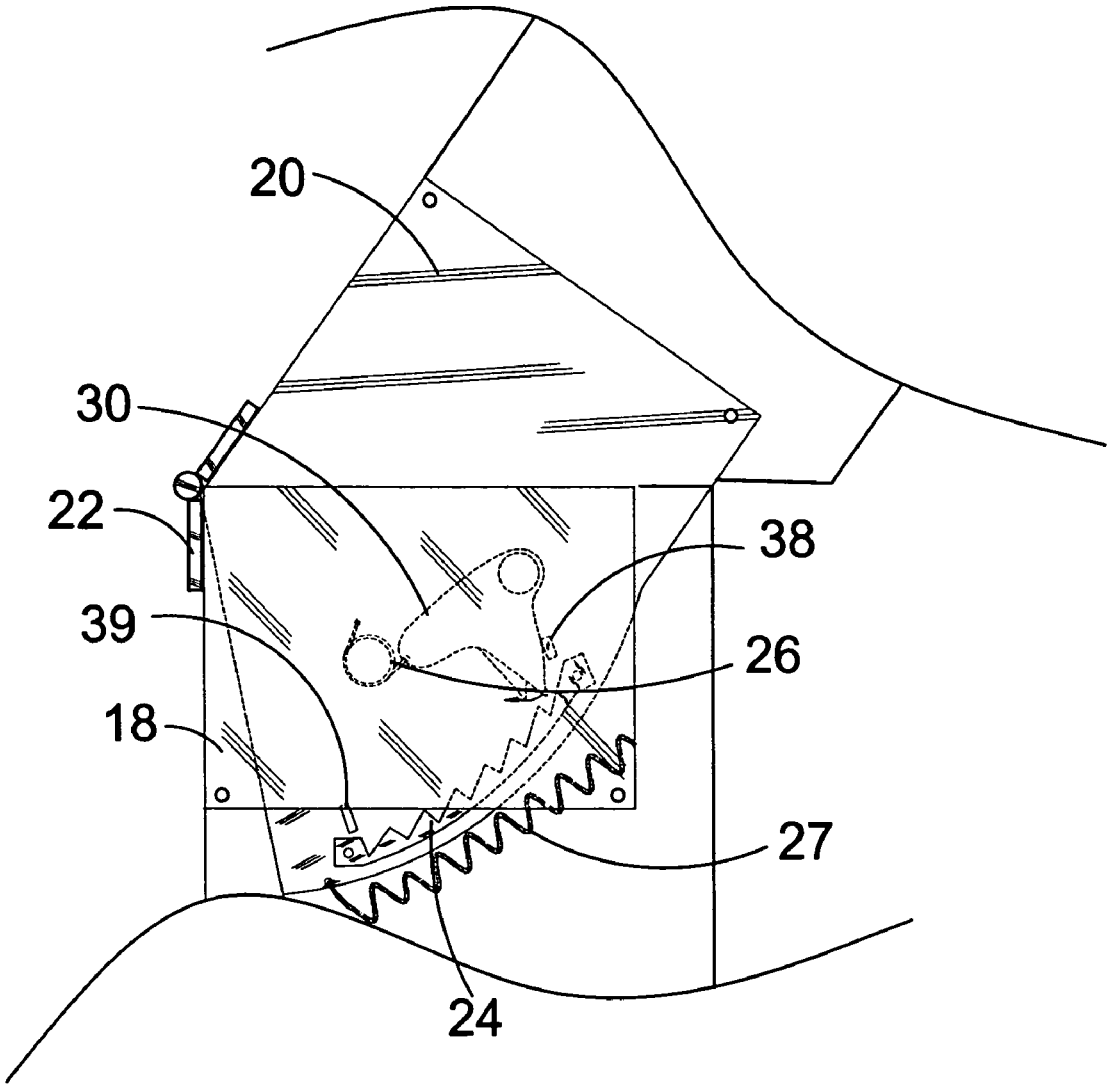
FIG. 9 is a side view of the ratchet assembly of the present invention engaging the stop at the last position.

Turning to FIG. 9, shown therein is a side view of the ratchet assembly 24 of the present invention engaging the stop 38 at the last position. The present invention discloses an angularly adjustable recliner headrest having two rigid plates fixedly attached to the side walls of the recliner frame and comprised of a ratchet system 24 housed within a stationary end plate 18, having a rotative inner plate 20 with a hinge 22 mounted to the back of the frame which functions as a pivoting element. The inner plate 20 comprises a small ratchet plate 24 having a series of teeth arranged whereby a pawl 30 having a tip contacts the teeth to lock the headrest in a position desirable to the user. Also shown are pawl 30, spring 26, 27 and stops 38, 39.

Figure 10:
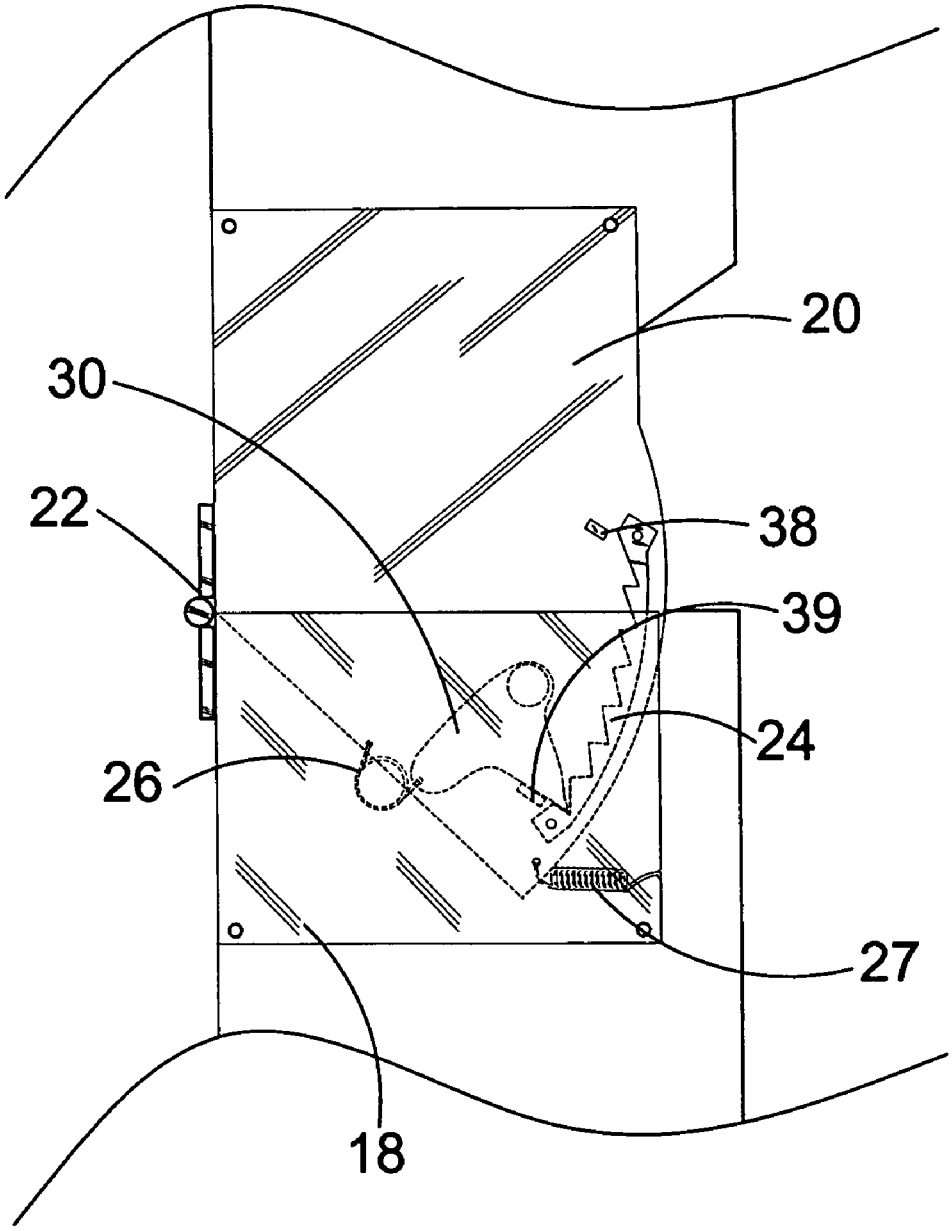
FIG. 10 is a side view of the ratchet assembly of the present invention back to first position.

Turning to FIG. 10, shown therein is a side view of the ratchet assembly of the present invention back to first position. The present invention 10 discloses an angularly adjustable recliner headrest having two rigid plates fixedly attached to the side walls of the recliner frame and comprised of a ratchet system 24 housed within a stationary end plate 18, having a rotative inner plate 20 with a hinge 22 mounted to the back of the frame which functions as a pivoting element. The inner plate 20 comprises a small ratchet plate 24 having a series of teeth arranged whereby a pawl having a tip contacts the teeth to lock the headrest in a position desirable to the user. Also shown are spring 26 and stops 38, 39. The ratchet plate 24, pawl 30, upper and lower stops 38, 39 and springs 26,27 provide means for controlling the movement of the pawl 30 whereby the pawl can engage the teeth of the ratchet plate when the headrest is in one position and then the pawl can disengage from the teeth and return to an original position when the headrest is in a second position. Also disclosed as a part of this means are a first helical spring 26 adapted for connection to the pawl 30 for biasing the movement of the pawl clockwise; a second longitudinally compressible spring 27 adapted for connection to the rotatable plate 20 for biasing the movement of the rotatable plate and the ratchet plate counterclockwise; upper and lower stops 38, 39 being disposed adjacent the upper and lower ends of the ratchet plate for stopping the movement of the pawl; and, wherein when the pawl contacts the upper stop when the backrest is in a first forward position the pawl is rotated partially clockwise so as to disengage from the teeth of the ratchet plate and the backrest is allowed to move to a second planar position wherein the pawl contacts the lower stop and is rotated partially clockwise so as to again engage the teeth.

I claim:

1. An adjustable headrest for a recliner chair, the recliner chair having a seat back with said adjustable headrest mounted on an upper end of said seat back and a seat cushion, said adjustable headrest comprising:

a) a first frame member being disposed internal the headrest and a second frame member adapted to be disposed internal the seat back of the chair for supporting the headrest and the seat back, said first and second frame members adapted to be being hinged together along a rear of the upper end of the seat back and along a rear of a lower end of said headrest, the upper end of the seat back and lower end of said headrest being shaped to allow said head rest to pivot forwardly toward the seat cushion from a position aligned with the back rest;

b) a first plate being disposed on a side surface of a lower end of said first frame member and a second plate mounted on a side surface of the upper end of said second frame member, said second plate having an opening between a portion of said second plate and the side surface of said second frame member, and said first plate having a toothed portion extending into said opening;

c) a pawl being rotatably disposed on said second plate inside said opening for engagement with said toothed portion of said first plate, said pawl and toothed portion forming a ratchet; and d) means for controlling the movement of said pawl whereby the pawl engages teeth of said toothed portion when the headrest is in one position and then the pawl can disengage from the teeth and return to an original position when the headrest is in a second position.

2. The apparatus of claim 1, wherein the headrest has an upper end thereon, wherein a handle member is disposed on said upper end of said headrest to permit the headrest to be moved.

3. The apparatus of claim 2, further comprising a cover being disposed over the apparatus to permit the apparatus to be covered for aesthetic purposes.

4. The apparatus of claim 3, wherein said pawl is disposed on a shaft, said shaft being generally horizontally disposed on an inside surface of said second plate within said opening to permit the pawl to move within said opening.

5. The apparatus of claim 4, wherein said means for controlling the movement of said pawl, comprises:

a) a first spring adapted for connection to said pawl for biasing the movement of said pawl clockwise;

b) a second spring adapted for connection to said second plate for biasing movement of said second plate and said toothed portion counterclockwise;

c) upper and lower stops being disposed adjacent said upper and lower ends of said toothed portion for stopping movement of the pawl; and, d) wherein when said pawl contacts said upper stop when said headrest is in its most forward position and contacts said lower stop when the headrest is in a position aligned with said seat back.

6. The apparatus of claim 5, wherein said first spring is a helical coil spring.

7. The apparatus of claim 6, wherein said second spring is a linearly compressible spring.

8. The apparatus of claim 7, wherein said pawl and said toothed portion are disposed in substantially the same vertical plane to permit them to operate in concert with each other.

9. The apparatus of claim 8, wherein said second spring has one end connected to a distal end of said toothed portion and a second connected to said second end frame member.

* * * * *